US005924169A

United States Patent [19]

Lu

[11] Patent Number: 5,924,169

[45] Date of Patent: Jul. 20, 1999

[54] SUITCASE HANDLE DEVICE

[75] Inventor: Lien-Ching Lu, Miao Li Hsien, Taiwan

[73] Assignee: Ting Cheng Co., Ltd., Miao Li Hsien, Taiwan

[21] Appl. No.: 08/948,177

[22] Filed: Oct. 9, 1997

[51] Int. Cl.[6] ..... B65D 25/28; A45C 13/26

[52] U.S. Cl. ..... 16/115; 190/115; 280/47.315; 280/655.1

[58] Field of Search ..... 16/115; 190/115; 280/47.315, 655, 655.1

[56] References Cited

U.S. PATENT DOCUMENTS

| | | | |
|---|---|---|---|
| 2,260,785 | 10/1941 | Miguel | 16/115 |
| 5,465,462 | 11/1995 | Yamada | 16/115 |
| 5,530,990 | 7/1996 | Chen | 16/115 |
| 5,533,601 | 7/1996 | Wang | 16/115 |
| 5,613,273 | 3/1997 | Tsai | 16/115 |
| 5,624,012 | 4/1997 | Wang | 190/115 |
| 5,713,440 | 2/1998 | Chen | 16/115 |
| 5,816,375 | 10/1998 | Tu | 16/115 |

*Primary Examiner*—Chuck Y. Mah
*Assistant Examiner*—Donald M. Gurley
*Attorney, Agent, or Firm*—Alan Kamrath; Oppenheimer Wolff & Donnelly LLP

[57] ABSTRACT

A suitcase handle device has a positioning seat disposed in a top portion of the suitcase, a grip seat disposed on the positioning seat, a grip disposed on the grip seat, and a press plate disposed in the grip seat. The positioning seat has a first square recess and a second square recess. The grip seat has a first distal sleeve inserted in the first square recess, a first through hole, a first passage, a second distal sleeve inserted in the second square recess, a second through hole, a second passage, a recess hole, two lateral plates, a slide rail, and an extended hole. The press plate has a base seat, a neck portion, a press portion, a protruded block, and a round hole receiving a coiled spring. The extended hole receives the protruded block. The lateral plates clamp the neck portion. The base seat slides in the slide rail. The grip has a first distal arm receiving a first inner pipe and a second distal arm receiving a second inner pipe.

3 Claims, 4 Drawing Sheets

SUITCASE HANDLE DEVICE

BACKGROUND OF THE INVENTION

The present invention relates to a suitcase handle device. More particularly, the present invention relates to a suitcase handle device which can be ejected easily.

A conventional handle device of a suitcase is often disposed out of the suitcase. Therefore, the conventional handle device may occupy a large room.

SUMMARY OF THE INVENTION

An object of the present invention is to provide a suitcase handle device which can be ejected easily.

Accordingly, a suitcase handle device is disposed on a top portion of a suitcase. The suitcase handle device comprises a positioning seat disposed in the top portion of the suitcase stably, a grip seat disposed on the positioning seat, a grip disposed on the grip seat, and a press plate disposed in the grip seat. The positioning seat has a plurality of through apertures, a first square recess, and a second square recess. Each through aperture receives a bolt. The bolts fasten the positioning seat on the suitcase. The grip seat has a first distal sleeve inserted in the first square recess, a first through hole formed in the first distal sleeve, a first passage communicating with the first through hole, a second distal sleeve inserted in the second square recess, a second through hole formed in the second distal sleeve, a second passage communicating with the second through hole, a recess hole formed in a center of the grip seat, two opposite lateral plates disposed in the center of the grip seat defining a slide rail, and an extended hole extending from the recess hole and communicating with the slide rail. The press plate has a base seat, a neck portion on the base seat, a press portion on the neck portion, a protruded block extended from the neck portion, and a round hole formed in the neck portion receiving a coiled spring. The extended hole receives the protruded block. The opposite lateral plates clamp the neck portion. The base seat slides in the slide rail. The grip has a first hollow distal arm, a first slot formed in the first hollow distal arm, a first blind hole formed in the first hollow distal arm, a second hollow distal arm, a second slot formed in the second hollow distal arm, a second blind hole formed in the second hollow distal arm, and a square hole. A first compression spring is inserted in the first blind hole. A first block plate blocks the first compression spring. A first notch is formed on the first block plate. A second compression spring is inserted in the second blind hole. A second block plate blocks the second compression spring. A second notch is formed on the second block plate. The first hollow distal arm is inserted in the first passage. The second hollow distal arm is inserted in the second passage. An upper end of a first inner pipe is inserted in the first hollow distal arm. A first screw fastens the first hollow distal arm and the first inner pipe together. An upper end of a second inner pipe is inserted in the second hollow distal arm. A second screw fastens the second hollow distal arm and the second inner pipe together. An upper end of a first outer pipe is inserted in the first distal sleeve. The first outer pipe receives the first inner pipe. An upper end of a second outer pipe is inserted in the second distal sleeve. The second outer pipe receives the second inner pipe.

DETAILED DESCRIPTION OF THE INVENTION

Figure 1:
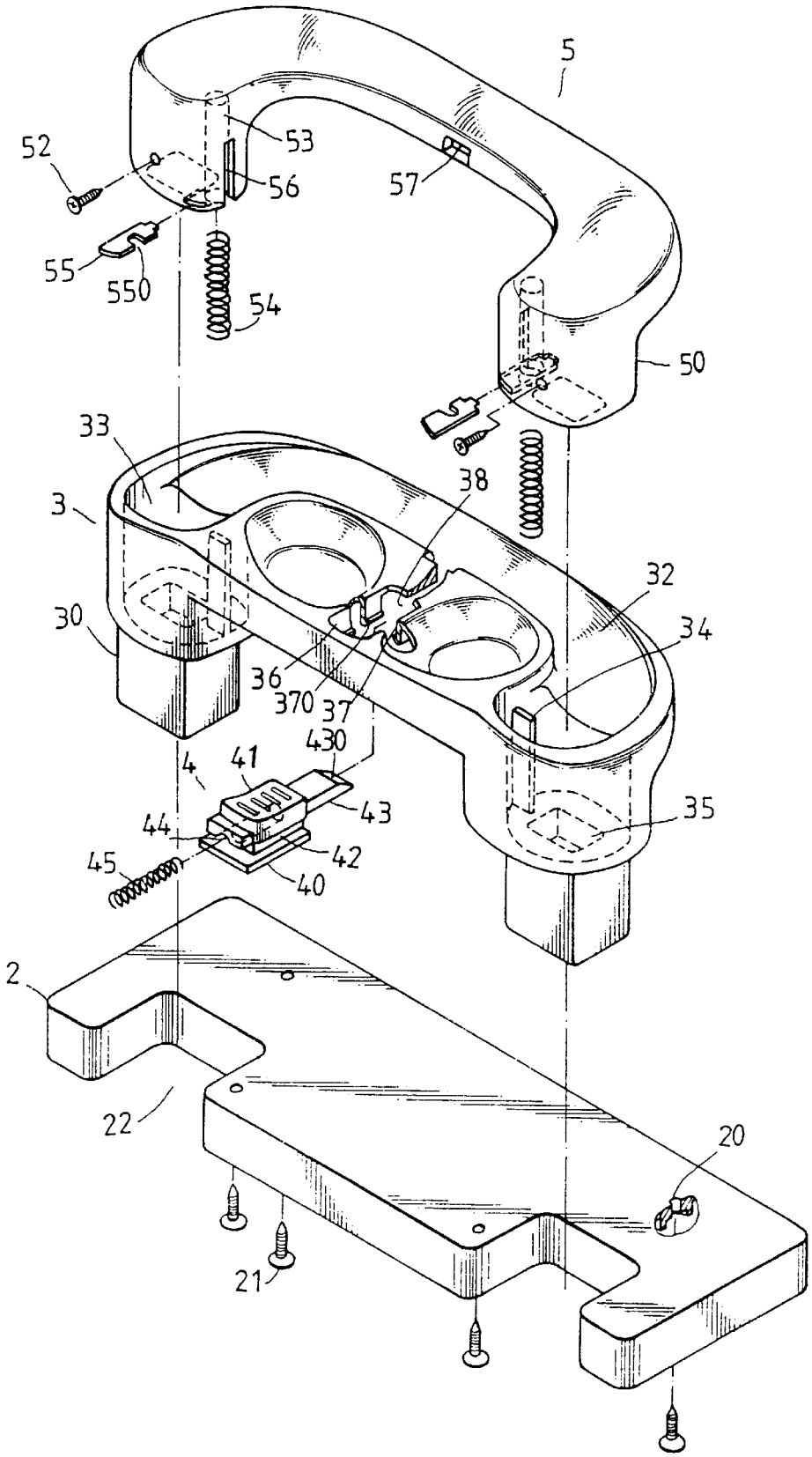
FIG. 1 is a perspective exploded view of a grip, a grip seat, a positioning seat, and a press plate.
Figure 2:
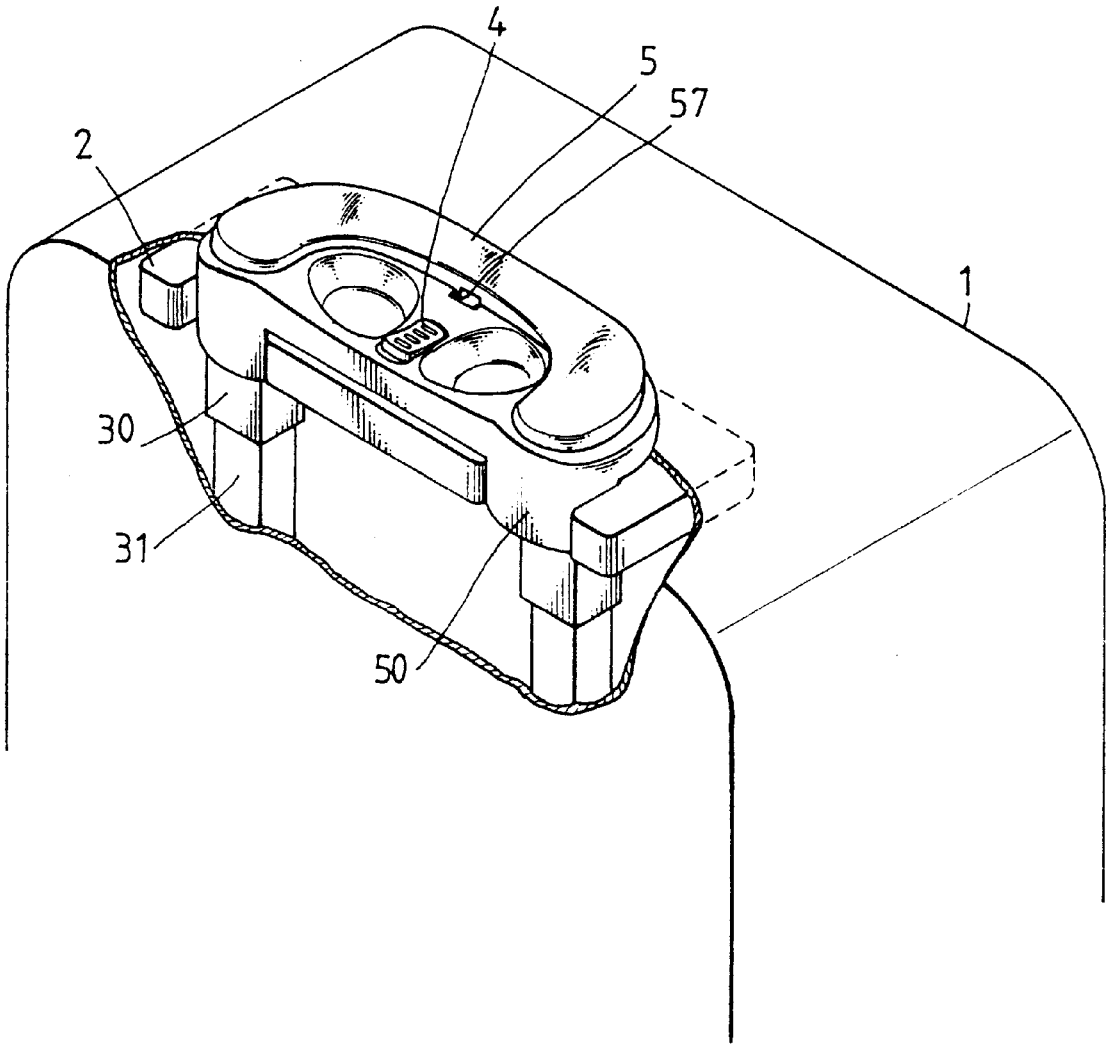
FIG. 2 is a perspective assembly view of a suitcase handle device of a preferred embodiment in accordance with the present invention.
Figure 3:
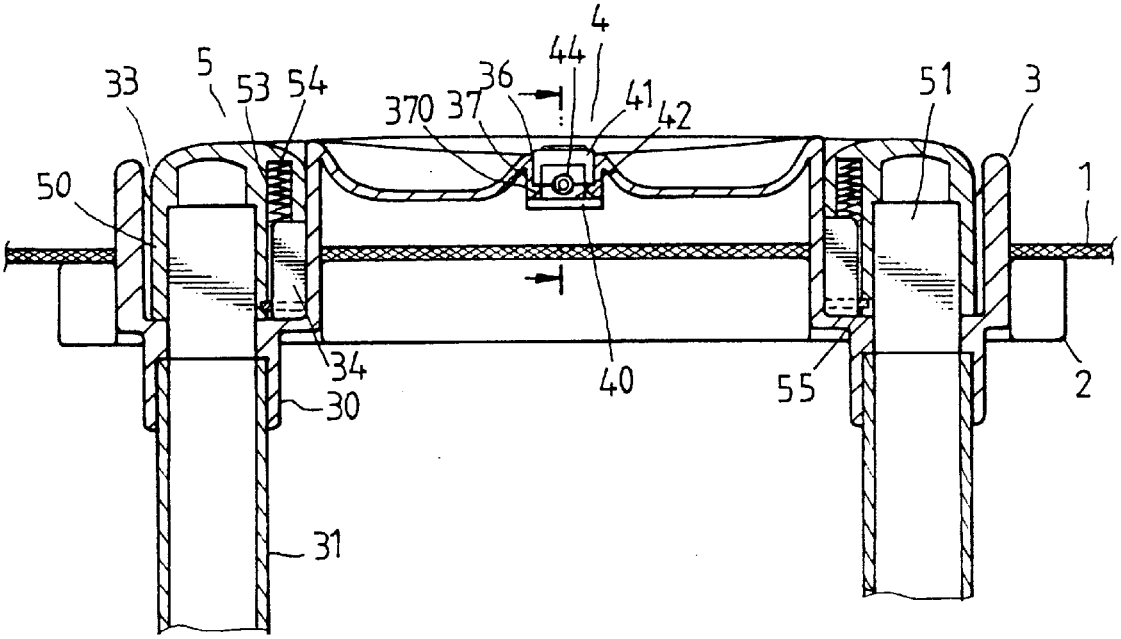
FIG. 3 is a sectional assembly view of a suitcase handle device of a preferred embodiment in accordance with the present invention.
Figure 4:
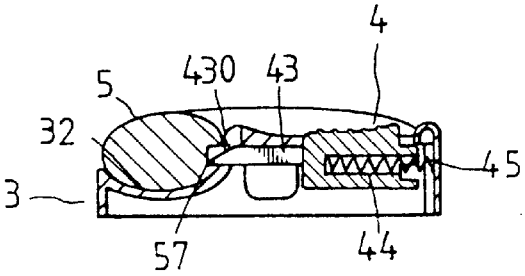
FIG. 4 is a sectional view of a press plate.

Referring to FIGS. 1 to 4, a suitcase handle device is disposed on a top portion of a suitcase 1. The suitcase handle device comprises a positioning seat 2 disposed in the top portion of the suitcase 1 stably, a grip seat 3 disposed on the positioning seat 2, a grip 5 disposed on the grip seat 3, and a press plate 4 disposed in the grip seat 3.

The positioning seat 2 has a plurality of through apertures 20, a first square recess 22, and a second square recess 22. Each through aperture 20 receives a bolt 21. The bolts 21 fasten the positioning seat 2 on the suitcase 1.

The grip seat 3 has a first distal sleeve 30 inserted in the first square recess 22, a first through hole 35 formed in the first distal sleeve 30, a first passage 33 communicating with the first through hole 35, a first rib 34 disposed in the first passage 33, a second distal sleeve 30 inserted in the second square recess 22, a second through hole 35 formed in the second distal sleeve 30, a second passage 33 communicating with the second through hole 35, a second rib 34 disposed in the second passage 33, a recess hole 36 formed in a center of the grip seat 3, two opposite lateral plates 37 disposed in the center of the grip seat 3 defining a slide rail 370, and an extended hole 38 extending from the recess hole 36 and communicating with the slide rail 370.

The press plate 4 has a base seat 40, a neck portion 42 on the base seat 40, a press portion 41 on the neck portion 42, a protruded block 43 extended from the neck portion 42, and a round hole 44 formed in the neck portion 42 receiving a coiled spring 45. A bevel 430 is formed on a distal end of the protruded block 43. The extended hole 38 receives the protruded block 43. The opposite lateral plates 37 clamp the neck portion 42. The base seat 40 slides in the slide rail 370.

The grip 5 has a first hollow distal arm 50, a first slot 56 formed in the first hollow distal arm 50, a first blind hole 53 formed in the first hollow distal arm 50, a second hollow distal arm 50, a second slot 56 formed in the second hollow distal arm 50, a second blind hole 53 formed in the second hollow distal arm 50, and a square hole 57. A first compression spring 54 is inserted in the first blind hole 53. A first block plate 55 blocks the first compression spring 54. A first notch 550 is formed on the first block plate 55. A second compression spring 54 is inserted in the second blind hole 53. A second block plate 55 blocks the second compression spring 54. A second notch 550 is formed on the second block plate 55. The first hollow distal arm 50 is inserted in the first passage 33. The second hollow distal arm 50 is inserted in the second passage 33.

An upper end of a first inner pipe 51 is inserted in the first hollow distal arm 50. A first screw 52 fastens the first hollow distal arm 50 and the first inner pipe 51 together. An upper end of a second inner pipe 51 is inserted in the second hollow distal arm 50. A second screw 52 fastens the second hollow distal arm 50 and the second inner pipe 51 together.

An upper end of a first outer pipe 31 is inserted in the first distal sleeve 30. The first outer pipe 31 receives the first inner pipe 51. An upper end of a second outer pipe 31 is inserted in the second distal sleeve 30. The second outer pipe 31 receives the second inner pipe 51.

The first rib 34 is inserted in the first slot 56. The second rib 34 is inserted in the second slot 56.

Referring to FIGS. 3 and 4 again, the grip 5 is pressed downward. The press plate 4 moves backward. The coiled spring 45 is compressed. Then the coiled spring 45 forces the press plate 4 to move frontward. The protruded block 43 is inserted in the square hole 57.

Figure 5:
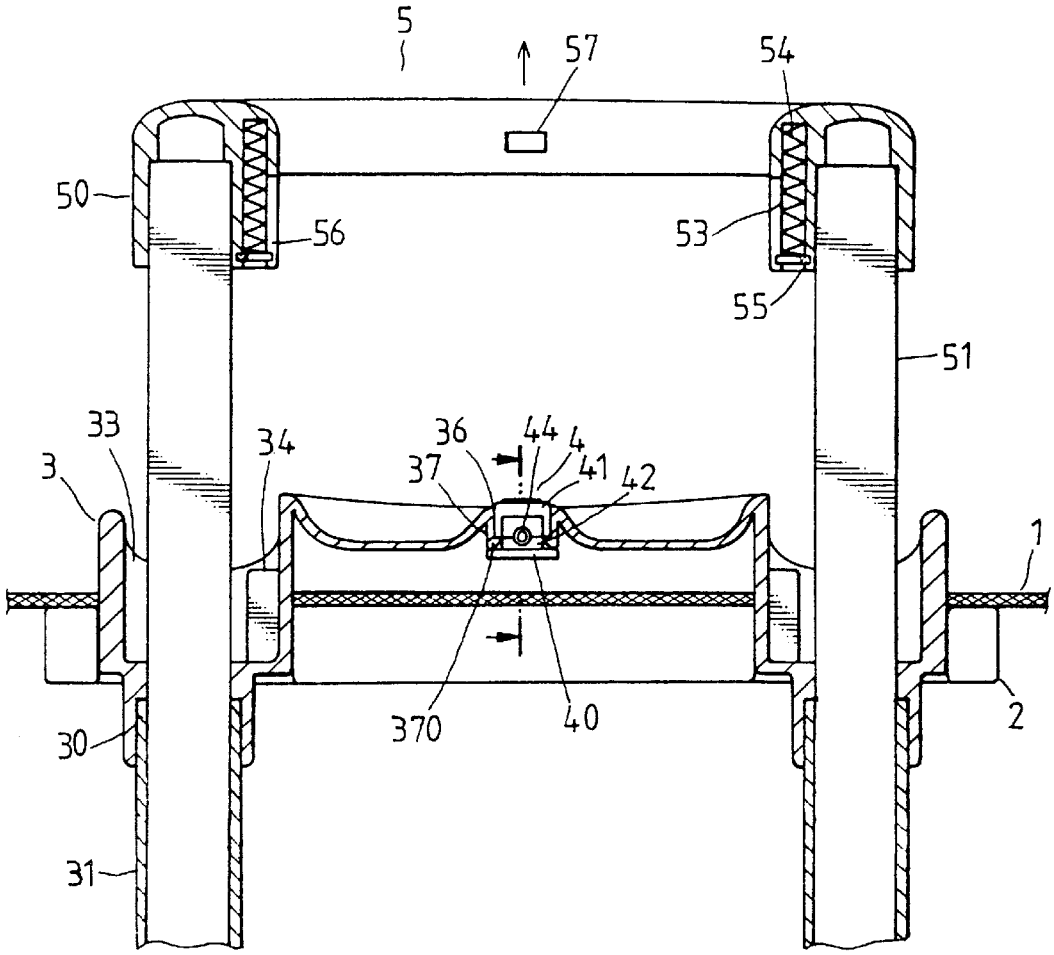
FIG. 5 is a schematic view illustrating a suitcase handle device is ejected.
Figure 6:
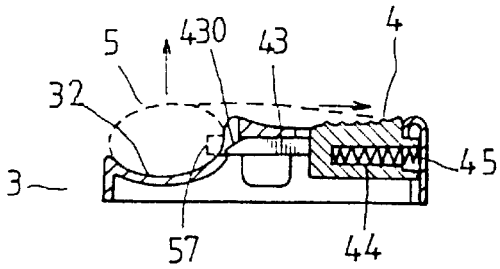
FIG. 6 is a schematic view illustrating a press plate is pushed.

Referring to FIGS. 5 and 6, the press plate 4 is pressed backward. The protruded block 43 disengages from the square hole 57. Then the ribs 34 press the compression springs 54 to eject upward.

The invention is not limited to the above embodiment but various modification thereof may be made. Further, various changes in form and detail may be made without departing from the scope of the invention.

I claim:

1. A suitcase handle device disposed on a top portion of a suitcase, the suitcase handle device comprising:

a positioning seat disposed in the top portion of the suitcase stably, a grip seat disposed on the positioning seat, a grip disposed on the grip seat, a press plate disposed in the grip seat, the positioning seat having a plurality of through apertures, a first square recess, and a second square recess, each of the through apertures receiving a bolt, the grip seat having a first distal sleeve inserted in the first square recess, a first through hole formed in the first distal sleeve, a first passage communicating with the first through hole, a second distal sleeve inserted in the second square recess, a second through hole formed in the second distal sleeve, a second passage communicating with the second through hole, a recess hole formed in a center of the grip seat, two opposite lateral plates disposed in the center of the grip seat defining a slide rail, and an extended hole extending from the recess hole and communicating with the slide rail, the press plate having a base seat, a neck portion on the base seat, a press portion on the neck portion, a protruded block extended from the neck portion, and a round hole formed in the neck portion receiving a coiled spring, the extended hole receiving the protruded block, the opposite lateral plates clamping the neck portion, the base seat sliding in the slide rail, the grip having a first hollow distal arm, a first slot formed in the first hollow distal arm, a first blind hole formed in the first hollow distal arm, a second hollow distal arm, a second slot formed in the second hollow distal arm, a second blind hole formed in the second hollow distal arm, and a square hole, a first compression spring inserted in the first blind hole, a first block plate blocking the first compression spring, a first notch formed on the first block plate, a second compression spring inserted in the second blind hole, a second block plate blocking the second compression spring, a second notch formed on the second block plate, the first hollow distal arm inserted in the first passage, the second hollow distal arm inserted in the second passage, an upper end of a first inner pipe inserted in the first hollow distal arm, a first screw fastening the first hollow distal arm and the first inner pipe together, an upper end of a second inner pipe inserted in the second hollow distal arm, a second screw fastening the second hollow distal arm and the second inner pipe together, an upper end of a first outer pipe inserted in the first distal sleeve, the first outer pipe receiving the first inner pipe, an upper end of a second outer pipe inserted in the second distal sleeve, and the second outer pipe receiving the second inner pipe.

2. A suitcase handle device as claimed in claim 1, wherein a first rib is inserted in the first slot and a second rib is inserted in the second slot.

3. A suitcase handle device as claimed in claim 1, wherein a bevel is formed on a distal end of the protruded block.

* * * * *